US011499544B2

(12) United States Patent
Beisel

(10) Patent No.: US 11,499,544 B2
(45) Date of Patent: Nov. 15, 2022

(54) PRESSURE PUMP PERFORMANCE MONITORING SYSTEM USING TORQUE MEASUREMENTS

(71) Applicant: Halliburton Energy Services, Inc., Houston, TX (US)

(72) Inventor: Joseph A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 804 days.

(21) Appl. No.: 16/310,879

(22) PCT Filed: Aug. 31, 2016

(86) PCT No.: PCT/US2016/049682
§ 371 (c)(1),
(2) Date: Dec. 18, 2018

(87) PCT Pub. No.: WO2018/044293
PCT Pub. Date: Mar. 8, 2018

(65) Prior Publication Data

US 2021/0222690 A1 Jul. 22, 2021

(51) Int. Cl.
*F04B 51/00* (2006.01)
*F04B 49/06* (2006.01)
*F04B 49/10* (2006.01)

(52) U.S. Cl.
CPC ..... *F04B 51/00* (2013.01); *F04B 49/065* (2013.01); *F04B 49/10* (2013.01);
(Continued)

(58) Field of Classification Search
CPC ..... F04B 2201/0201; F04B 2201/0601; F04B 2201/0605; F04B 2201/1202;
(Continued)

(56) References Cited

U.S. PATENT DOCUMENTS 3,921,435 A 11/1975 Howard
4,333,424 A 6/1982 McFee
(Continued)

FOREIGN PATENT DOCUMENTS

CA 2995687 5/2019
CA 2993150 9/2019
(Continued)

OTHER PUBLICATIONS

International Patent Application No. PCT/US2016/049682 , "International Search Report and Written Opinion", dated May 23, 2017, 17 pages.

*Primary Examiner* — Christopher S Bobish
(74) *Attorney, Agent, or Firm* — Kilpatrick Townsend & Stockton LLP

(57) ABSTRACT

A monitoring system may include a strain gauge, a position sensor, and a torque sensor. The strain gauge may measure strain in a chamber of the pressure pump and generate a strain signal representing the strain measurement. The position sensor may measure a position of a rotating member and generate a position signal representing the position measurement. The torque sensor may measure torque in a component of the pressure pump and generate a torque signal representing the torque measurement. The torque measurement may be used with the strain measurement and the position measurement to determine a condition of the pressure pump.

20 Claims, 11 Drawing Sheets

(52) U.S. Cl.
CPC ..... *F04B 2201/0201* (2013.01); *F04B 2201/0601* (2013.01); *F04B 2201/0605* (2013.01); *F04B 2201/1202* (2013.01); *F04B 2201/1208* (2013.01); *F04B 2203/0207* (2013.01); *F04B 2205/09* (2013.01)

(58) Field of Classification Search
CPC ..... F04B 2203/0207; F04B 2205/09; F04B 49/065; F04B 51/00; F04B 2201/1208; F04B 49/10
See application file for complete search history.

(56) References Cited

U.S. PATENT DOCUMENTS 4,705,459 A * 11/1987 Buisine ..... F04B 51/00 417/53
RE33,649 E 7/1991 Kawai
5,180,287 A 1/1993 Natwick et al.
5,846,056 A 12/1998 Dhindsa et al.
6,155,347 A 12/2000 Mills
6,330,525 B1 * 12/2001 Hays ..... F04D 15/0088 702/182
6,859,740 B2 2/2005 Stephenson et al.
6,882,960 B2 4/2005 Miller
7,043,975 B2 5/2006 Du
7,080,508 B2 * 7/2006 Stavale ..... F04D 15/0066 60/431
7,508,149 B2 * 3/2009 Patel ..... F04B 49/06 318/432
7,581,449 B2 * 9/2009 Miller ..... F04B 51/00 73/744
7,623,986 B2 11/2009 Miller
8,147,211 B2 * 4/2012 Grant ..... F04B 51/00 417/63
8,807,960 B2 8/2014 Stephenson et al.
8,905,056 B2 12/2014 Kendrick
9,071,110 B2 * 6/2015 Lalonge ..... H02K 11/20
9,759,213 B2 9/2017 Bassett et al.
9,797,395 B2 * 10/2017 Urdaneta ..... F04B 47/00
9,920,615 B2 * 3/2018 Zhang ..... E21B 43/26
9,934,671 B1 4/2018 Anderson
10,001,121 B2 * 6/2018 van der Merwe ..... F04C 28/08
10,480,296 B2 11/2019 Beisel
10,564,020 B2 2/2020 Beisel
10,801,491 B2 * 10/2020 Urdaneta ..... F04B 53/00
10,895,254 B2 1/2021 Beisel
10,914,302 B2 2/2021 Beisel
10,927,831 B2 2/2021 Beisel
2002/0007952 A1 1/2002 Vann
2002/0176784 A1 11/2002 Du
2004/0013539 A1 * 1/2004 Takagi ..... F04B 53/1077 417/300
2004/0018100 A1 1/2004 Takagi et al.
2004/0144529 A1 7/2004 Barnes et al.
2004/0158419 A1 8/2004 Pearson et al.
2005/0025631 A1 2/2005 Lake et al.
2005/0180868 A1 8/2005 Miller
2006/0037408 A1 2/2006 Peter
2006/0228225 A1 10/2006 Rogers et al.
2007/0041849 A1 2/2007 Allen
2007/0139211 A1 6/2007 Pessin et al.
2007/0140869 A1 * 6/2007 St. Michel ..... F04B 9/00 417/53
2008/0260558 A1 10/2008 Luongo et al.
2009/0041588 A1 * 2/2009 Hunter ..... F04B 7/0076 417/27
2009/0129935 A1 5/2009 Kunkier et al.
2009/0180866 A1 7/2009 Bourgeois et al.
2009/0252620 A1 10/2009 Lazzara
2009/0317262 A1 12/2009 Gilpatrick
2010/0252262 A1 10/2010 Ekstrand et al.
2010/0300683 A1 * 12/2010 Looper ..... E21B 47/008 166/250.01
2010/0310384 A1 12/2010 Stephenson et al.
2011/0011581 A1 1/2011 Stephenson et al.
2011/0046903 A1 2/2011 Franklin
2011/0202275 A1 8/2011 Beisel et al.
2012/0144995 A1 6/2012 Bayyouk et al.
2013/0151216 A1 6/2013 Palka et al.
2013/0213647 A1 8/2013 Roddy et al.
2013/0261993 A1 10/2013 Ruchti et al.
2013/0317750 A1 11/2013 Hunter
2014/0096957 A1 4/2014 Van Zuilekom et al.
2014/0166267 A1 6/2014 Weightman et al.
2014/0166268 A1 6/2014 Weightman et al.
2014/0288858 A1 9/2014 Franklin
2015/0027693 A1 1/2015 Edwards et al.
2015/0083400 A1 3/2015 Stephenson et al.
2015/0132152 A1 * 5/2015 Lazzara ..... F04B 15/023 417/213
2015/0226058 A1 8/2015 Stolpman
2015/0377318 A1 12/2015 Byrne et al.
2016/0305419 A1 10/2016 Liu et al.
2016/0339535 A1 11/2016 Hess et al.
2017/0138142 A1 5/2017 Leach et al.
2017/0138645 A1 5/2017 Sakima et al.
2018/0223644 A1 8/2018 Beisel
2018/0230786 A1 8/2018 Beisel
2019/0154019 A1 * 5/2019 Kaufmann ..... F04B 51/00
2019/0264676 A1 * 8/2019 Merkel ..... F04B 53/001

FOREIGN PATENT DOCUMENTS

EP 1519185 3/2005
WO 2002025244 3/2002
WO 2010136746 12/2010
WO 2011095935 8/2011
WO 2014204316 12/2014
WO 2015023283 2/2015
WO 2017039692 3/2017
WO 2017039695 3/2017
WO 2017039698 3/2017
WO 2017039700 3/2017
WO 2017039701 3/2017
WO 2017058161 4/2017
WO 2018044289 3/2018
WO 2018052425 3/2018

* cited by examiner

PRESSURE PUMP PERFORMANCE MONITORING SYSTEM USING TORQUE MEASUREMENTS

TECHNICAL FIELD

The present disclosure relates generally to pressure pumps for a wellbore and, more particularly (although not necessarily exclusively), to using torque measurements to monitor the performance of a pressure pump during operation in a wellbore environment.

BACKGROUND

Pressure pumps may be used in wellbore treatments. For example, hydraulic fracturing (also known as "fracking" or "hydro-fracking") may utilize a pressure pump to introduce or inject fluid at high pressures into a wellbore to create cracks or fractures in downhole rock formations. Due to the high-pressured and high-stressed nature of the pumping environment, pressure pump parts may undergo mechanical wear and require frequent replacement. Frequently changing parts may result in additional costs for the replacement parts and additional time due to the delays in operation while the replacement parts are installed.

DETAILED DESCRIPTION

Certain aspects and examples of the present disclosure relate to a pressure-pump monitoring system for identifying issues in a pressure pump by isolating discrepancies in torque values to a specific location of a torque measurement. The monitoring system may include a position sensor, a strain gauge, and a torque sensor. The position sensor may generate position signals corresponding to the movement of a crankshaft in the power end. The strain gauge may generate a strain signal corresponding to a strain in a fluid chamber located in a fluid end of the chamber. The position of the crankshaft and the strain in the chamber may be used, individually or collectively, to determine information about the fluid end of the pressure pump. The fluid-end information may include condition information about the component in the fluid end (e.g., leaks in the valves, cavitation in the chambers, etc.) and fluid information about fluid in the fluid end (e.g., flow rate of the fluid, bulk modulus, etc.). The fluid information may be used to generate expected conditions of the pressure pump in the power end and the fluid end. The torque sensor may be positioned in the pressure pump to generate a signal corresponding to the torque of a component of the pressure pump proximate to the torque sensor. The torque signal may be compared to the expected conditions of the pressure pump to determine abnormalities. The abnormalities may correspond to a condition of the component to which the torque sensor is proximate.

A monitoring system according to some aspects may protect components of the pressure pump by quickly identifying when an issue is present in the pressure pump as well as a location of the issue in the power end or the fluid end prior to the issue exacerbating to cause significant damage. The monitoring system may determine the performance of the components throughout the pressure pump's operation to allow the pressure pump to undergo maintenance on an as-needed basis, rather than scheduled by a predetermined number of stages. The downtime caused by prescheduled and unnecessary maintenance may be reduced to save avoidable replacement costs and in the time and labor in performing pump maintenance.

These illustrative examples are provided to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative examples but, like the illustrative examples, should not be used to limit the present disclosure. The various figures described below depict examples of implementations for the present disclosure, but should not be used to limit the present disclosure.

Figure 1A:
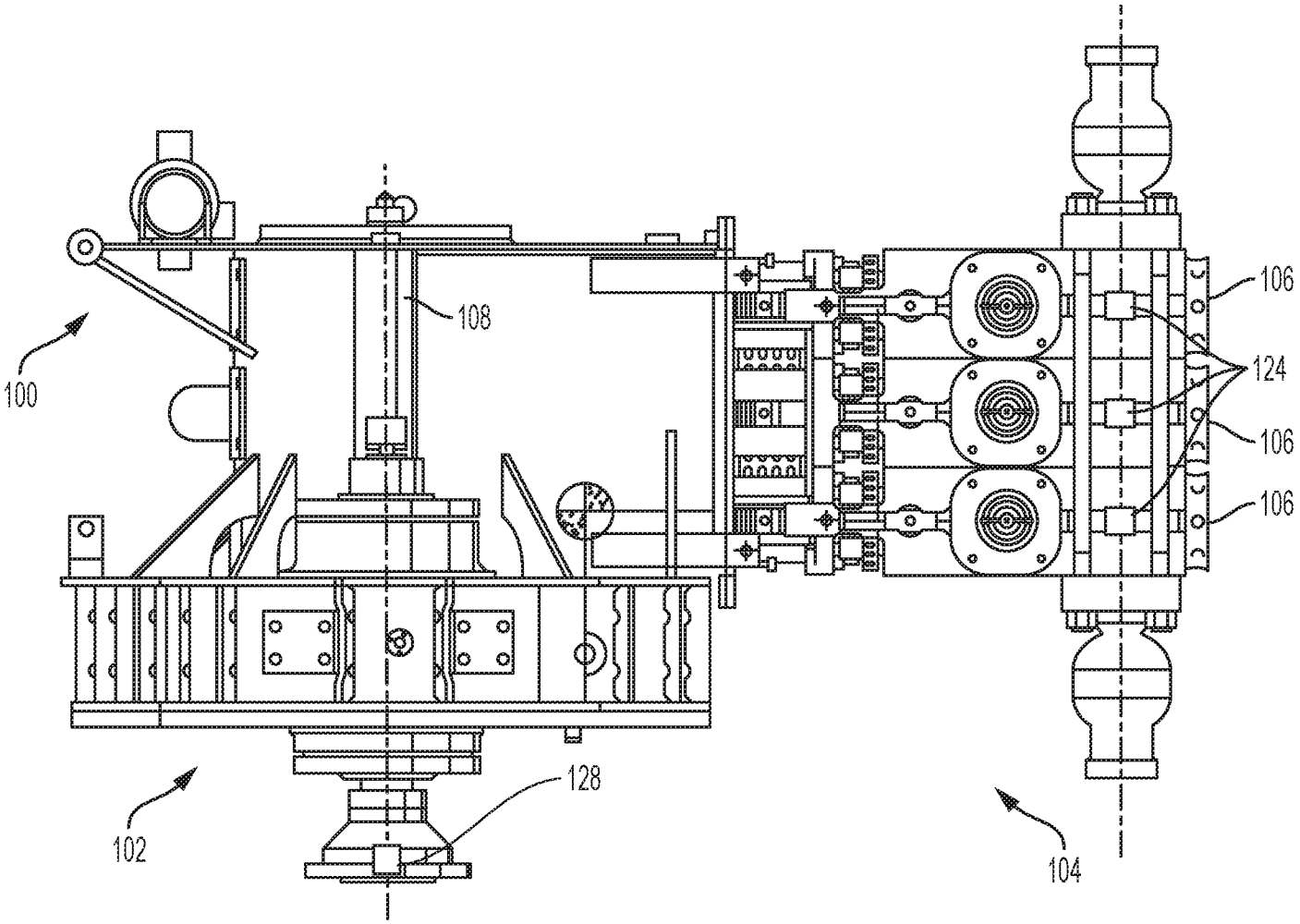
FIG. 1A is a cross-sectional, top view schematic diagram depicting an example of a pressure pump that includes a monitoring system according to one aspect of the present disclosure.
Figure 1B:
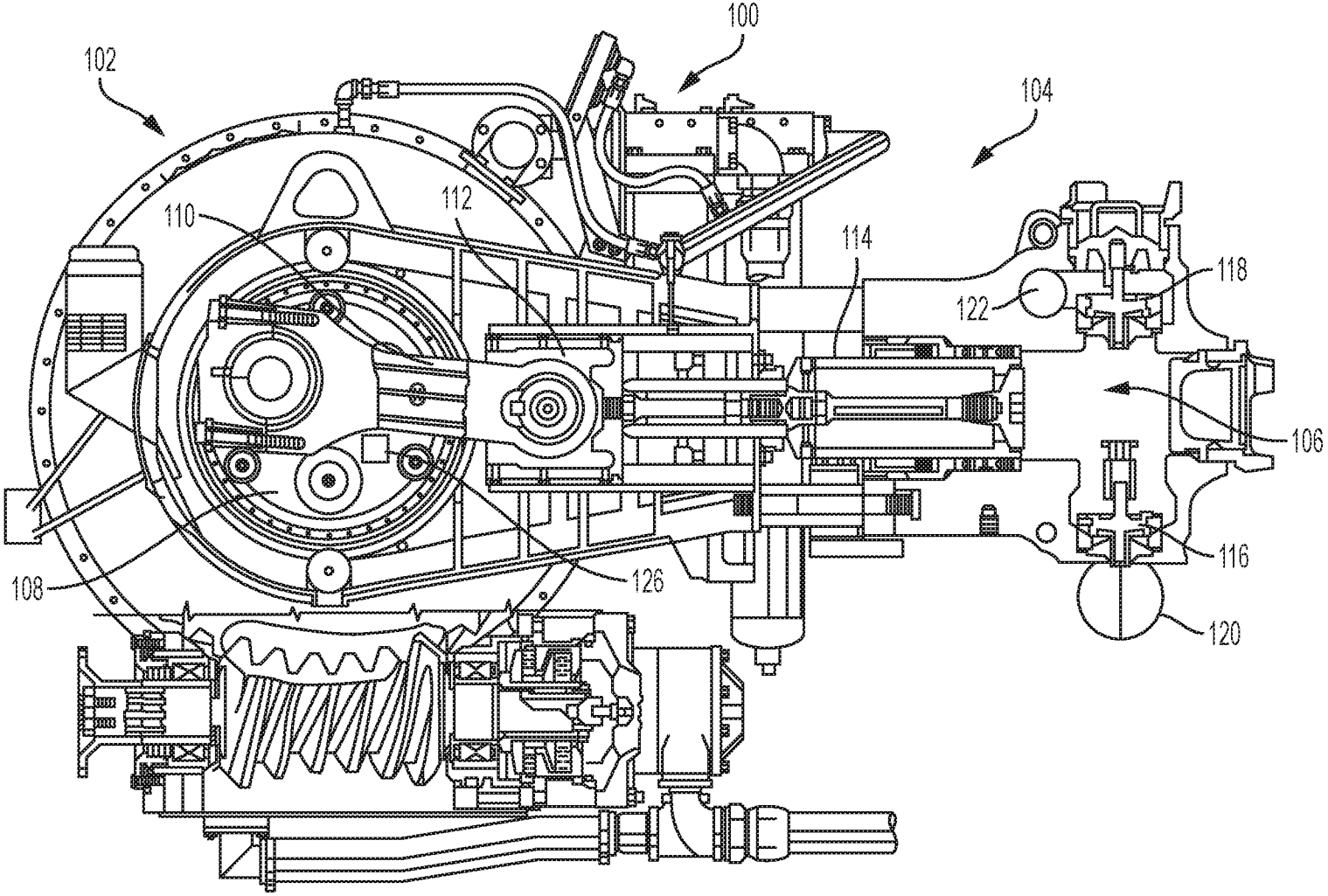
FIG. 1B is a cross-sectional, side view schematic diagram depicting the pressure pump of FIG. 1A according to one aspect of the present disclosure.

FIGS. 1A and 1B show a pressure pump 100 that may utilize a monitoring system according to some aspects of the present disclosure. The pressure pump 100 may be any positive displacement pressure pump. The pressure pump 100 may include a power end 102 and a fluid end 104. The power end 102 may be coupled to a motor, engine, or other prime mover for operation. The fluid end 104 includes chambers 106 for receiving and discharging fluid flowing through the pressure pump 100. Although FIG. 1A shows three chambers 106 in the pressure pump 100, the pressure pump 100 may include any number of chambers 106, including one, without departing from the scope of the present disclosure.

The pressure pump 100 may also include a rotating assembly. The rotating assembly may include a crankshaft 108, one or more connecting rods 110, a crosshead 112, plungers 114, and related elements (e.g., pony rods, clamps, etc.). The crankshaft 108 may be positioned in the power end 102 of the pressure pump 100 and may be mechanically connected to a plunger 114 in a chamber 106 of the pressure pump via the connecting rods 110 and the crosshead 112. The crankshaft 108 may cause a plunger 114 located in a chamber 106 to displace any fluid in the chamber 106. In some aspects, each chamber 106 of the pressure pump 100 may include a separate plunger 114, each plunger 114 in each chamber 106 mechanically connected to the crankshaft 108 via the connecting rod 110 and the crosshead 112. Each chamber 106 may include a suction valve 116 and a discharge valve 118 for absorbing fluid into the chamber 106 and discharging fluid from the chamber 106, respectively. The fluid may be absorbed into and discharged from the chamber 106 in response to a movement of the plunger 114 in the chamber 106. Based on the mechanical coupling of the crankshaft 108 to the plunger 114 in the chamber 106, the movement of the plunger 114 may be directly related to the movement of the crankshaft 108.

A suction valve 116 and a discharge valve 118 may be included in each chamber 106 of the pressure pump 100. In some aspects, the suction valve 116 and the discharge valve 118 may be passive valves. As the plunger 114 operates in the chamber 106, the plunger 114 may impart motion and pressure to the fluid by direct displacement. The suction valve 116 and the discharge valve 118 may open and close based on the displacement of the fluid in the chamber 106 by the plunger 114. For example, the suction valve 116 may be opened during when the plunger 114 recesses to absorb fluid from outside of the chamber 106 into the chamber 106. As the plunger 114 is withdrawn from the chamber 106, it may create a differential pressure to open the suction valve 116 and allow fluid to enter the chamber 106. In some aspects, the fluid may be absorbed into the chamber 106 from an inlet manifold 120. Fluid already in the chamber 106 may move to fill the space where the plunger 114 was located in the chamber 106. The discharge valve 118 may be closed during this process.

The discharge valve 118 may be opened as the plunger 114 moves forward or reenters the chamber 106. As the plunger 114 moves further into the chamber 106, the fluid may be pressurized. The suction valve 116 may be closed during this time to allow the pressure on the fluid to force the discharge valve 118 to open and discharge fluid from the chamber 106. In some aspects, the discharge valve 118 may discharge the fluid into a discharge manifold 122. The loss of pressure inside the chamber 106 may allow the discharge valve 118 to close and the load cycle may restart. Together, the suction valve 116 and the discharge valve 118 may operate to provide the fluid flow in a desired direction. The process may include a measurable amount of pressure and stress in the chamber 106, such as the stress resulting in strain to the chamber 106 or fluid end 104 of the pressure pump 100. In some aspects, a measurement system may be coupled to the pressure pump 100 to measure the strain and determine a condition of the suction valve 116 and the discharge valve 118 in the chamber 106.

In some aspects, a measurement system may be coupled to the pressure pump 100 to measure the strain and determine actuation of the suction valve 116 and the discharge valve 118 in the chamber 106. For example, a measurement system may include one or more strain gauges, one or more position sensors, and one or more torque sensors. The strain gauges positioned on an external surface of the fluid end 104 to measure strain in the chambers 106. Strain gauge 124 in FIG. 1A shows an example of a placement for the strain gauges that may be included in the measurement system. In some aspects, the measurement system may include a separate strain gauge to monitor strain in each chamber 106 of the pressure pump 100. The position sensors may be positioned on the power end 102 of the pressure pump 100 to sense the position of the crankshaft 108 or another rotating component of the pressure pump 100. Position sensor 126 shows an example of a placement of a position sensor on an external surface of the power end 102 to sense the position of the crankshaft 108. Measurements of the crankshaft position may allow the measurement system to determine the position of the plungers 114 in the respective chambers. The torque sensors may be positioned on the power end 102 (e.g., drivetrain, the crankshaft 108) or the fluid end 104 (e.g., the chamber 106) proximate to a component of the pressure pump to sense torque of the component. Torque sensor 128 shows one example of a placement of a torque sensor on the power end 102 of the pressure pump 100 to sense the torque of the crankshaft 108.

Figure 2:
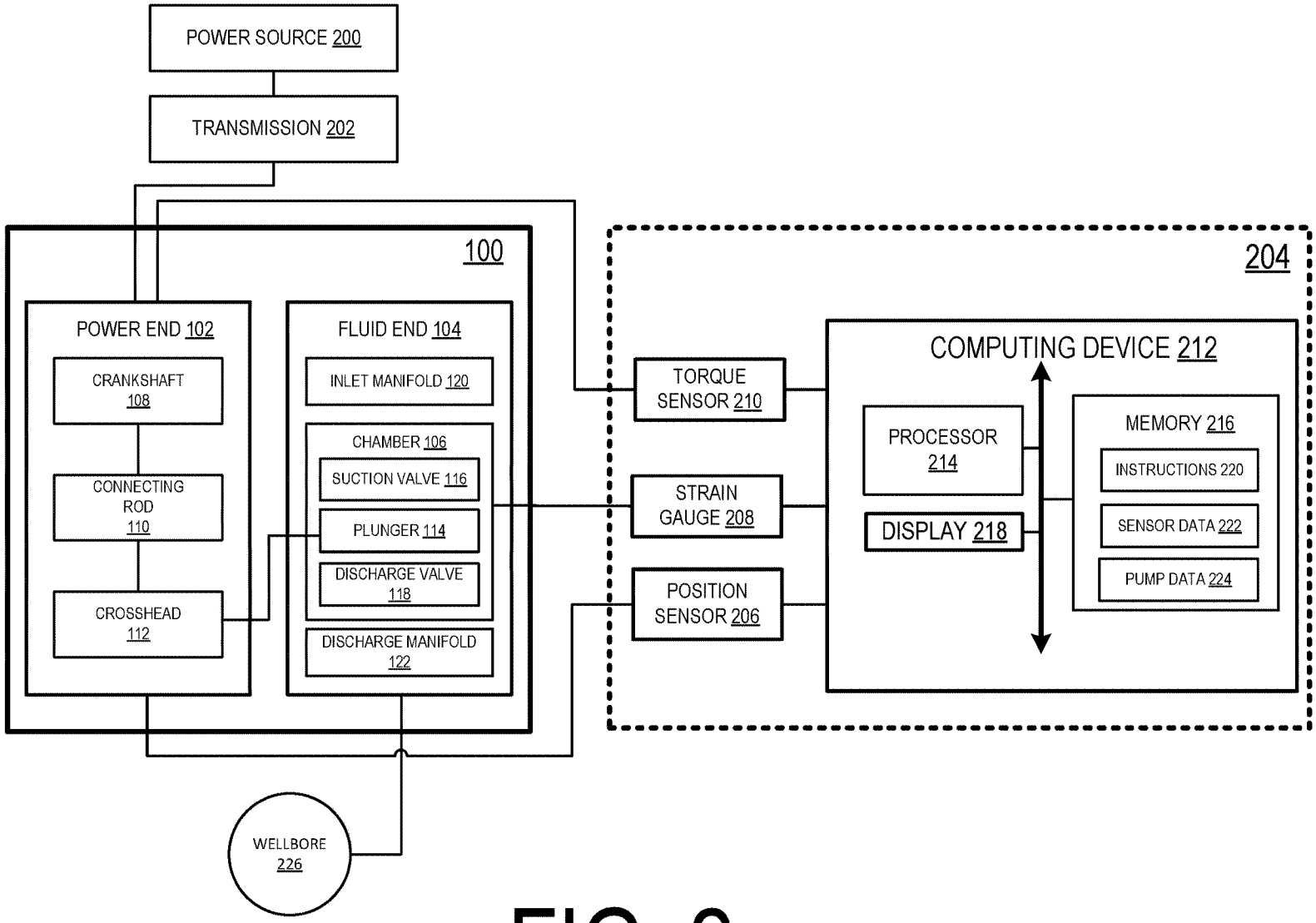
FIG. 2 is a block diagram depicting a power input and a monitoring system for a pressure pump according to one aspect of the present disclosure.

FIG. 2 is a block diagram showing an example of a power input and a monitoring system 204 coupled to the pressure pump 100 according to one aspect. The power input includes a power source 200 and a transmission 202. The power source 200 may include an engine, motor or other suitable power source that may be connected to the crankshaft 108 in the power end 102 of the pressure pump through a transmission 202 and a driveshaft mechanically connecting the power source 200 to the power end 102. Through the transmission 202, the power source 200 may rotate the driveshaft and, in turn, rotate the crankshaft 108.

The monitoring system 204 includes a position sensor 206, a strain gauge 208, a torque sensor 210, and a computing device 212. In some aspects, the computing device 212 may be communicatively coupled to the pressure pump 100 through the position sensor 206, the strain gauge 208, and the torque sensor 210. The position sensor 206 may include a single sensor or may represent an array of sensors. The position sensor 206 may be a magnetic pickup sensor capable of detecting ferrous metals in close proximity. The position sensor 206 may be positioned on the power end 102 of the pressure pump 100 for determining the position of the crankshaft 108. In some aspects, the position sensor 206 may be placed proximate to a path of the crosshead 112. The path of the crosshead 112 may be directly related to a rotation of the crankshaft 108. The position sensor 206 may sense the position of the crankshaft 108 based on the movement of the crosshead 112. In other aspects, the position sensor 206 may be placed directly on a crankcase of the power end 102 as illustrated by position sensor 206 in FIG. 1A. The position sensor 206 may determine a position of the crankshaft 108 by detecting a bolt pattern of the crankshaft 108 as the crankshaft 108 rotates during operation of the pressure pump 100. The position sensor 206 may generate a signal representing the position of the crankshaft 108 and transmit the signal to the computing device 212.

The strain gauge 208 may be positioned on the fluid end 104 of the pressure pump 100. The strain gauge 208 may include a single gauge or an array of gauges for determining strain in the chamber 106. Non-limiting examples of types of strain gauges include electrical resistance strain gauges, semiconductor strain gauges, fiber optic strain gauges, micro-scale strain gauges, capacitive strain gauges, vibrating wire strain gauges, etc. In some aspects, the monitoring system 204 may include a strain gauge 208 for each chamber 106 of the pressure pump 100 to determine strain in each of the chambers 106, respectively. In some aspects, the strain gauge 208 may be positioned on an external surface of the fluid end 104 of the pressure pump 100 in a position subject to strain in response to stress in the chamber 106. For example, the strain gauge 208 may be positioned on a section of the fluid end 104 in a manner such that when the chamber 106 loads up, strain may be present at the location of the strain gauge 208. This location may be determined based on engineering estimations, finite element analysis, or by some other analysis. The analysis may determine that strain in the chamber 106 may be directly over a plunger bore of the chamber 106 during load up. The strain gauge 208 may be placed on an external surface of the pressure pump 100 in a location directly over the plunger bore corresponding to the chamber 106 as illustrated by strain gauge 124 in FIG. 1A to measure strain in the chamber 106. The strain gauge 208 may generate a signal representing strain in the chamber 106 and transmit the signal to the computing device 212.

The torque sensor 210 may be positioned on the power end 102 or the fluid end 104 of the pressure pump 100. Non-limiting examples of a torque sensor may include a torque transducer, a torque-meter, strain gauges, etc. The torque sensor 210 may include a single torque sensor or multiple torque sensors positioned on or proximate to various components of the pressure pump 100 to sense the torque of the respective components. In some aspects, the torque sensor 210 may measure or record the torque on a rotating device, such as the power source 200, transmission 202, crankshaft 108, etc. In one aspect, the torque sensor 210 may be positioned at the input to the power end 102 of the pressure pump 100. For example, the torque sensor 210 may be incorporated into the transmission 202 using slip rings, calibrated tone wheels, or wireless torque meters.

The computing device 212 may be coupled to the position sensor 206, the strain gauge 208, and the torque sensor 210 to receive the respective signals from each. The computing device 212 includes a processor 214, a memory 216, and a display unit 218. In some aspects, the processor 214, the memory 216, and the display unit 218 may be communicatively coupled by a bus. The processor 214 may execute instructions 220 for monitoring the pressure pump 100 and determining conditions in the pressure pump 100. The instructions 220 may be stored in the memory 216 coupled to the processor 214 by the bus to allow the processor 214 to perform the operations. The processor 214 may include one processing device or multiple processing devices. Non-limiting examples of the processor 214 may include a Field-Programmable Gate Array ("FPGA"), an application-specific integrated circuit ("ASIC"), a microprocessor, etc. The non-volatile memory 216 may include any type of memory device that retains stored information when powered off. Non-limiting examples of the memory 216 may include electrically erasable and programmable read-only memory ("EEPROM"), a flash memory, or any other type of non-volatile memory. In some examples, at least some of the memory 216 may include a medium from which the processor 214 can read the instructions 220. A computer-readable medium may include electronic, optical, magnetic, or other storage devices capable of providing the processor 214 with computer-readable instructions or other program code (e.g., instructions 220). Non-limiting examples of a computer-readable medium include (but are not limited to) magnetic disks(s), memory chip(s), ROM, random-access memory ("RAM"), an ASIC, a configured processor, optical storage, or any other medium from which a computer processor can read the instructions 220. The instructions 220 may include processor-specific instructions generated by a compiler or an interpreter from code written in any suitable computer-programming language, including, for example, C, C++, C#, etc.

In some examples, the computing device 212 may determine an input for the instructions 220 based on sensor data 222 from the position sensor 206, the strain gauge 208, the torque sensor 210, data input into the computing device 212 by an operator, or other input means. For example, the position sensor 206 or the strain gauge 208 may measure a parameter (e.g., the position of the crankshaft 108, strain in the chamber 106) associated with the pressure pump 100 and transmit associated signals to the computing device 212. The computing device 212 may receive the signals, extract data from the signals, and store the sensor data 222 in memory 216. In another example, the torque sensor 210 may measure the torque in the crankshaft 108 of the pressure pump 100 during operating of the pressure pump 100. The torque sensor 210 may transmit a torque signal representing a torque of the crankshaft 108 to the computing device 212

In additional aspects, the computing device 212 may determine an input for the instructions 220 based on pump data 224 stored in the memory 216. In some aspects, the pump data 224 may be stored in the memory 216 in response to previous determinations by the computing device 212. For example, the processor 214 may execute instructions 220 to cause the processor 214 to perform pump-monitoring tasks and may store the information that is received during monitoring of the pressure pump 100 as pump data 224 in the memory 216 for further use in pumping and monitoring operations (e.g., calibrating the pressure pump, determining conditions in the pressure pump, comparing changes in bulk modulus or fluid density, determining expected valve actuation delays, etc.). In additional aspects, the pump data 224 may include other known information, including, but not limited to, the position of the position sensor 206, the strain gauge 208, or the torque sensor 210 in or on the pressure pump 100. For example, the computing device 212 may use the position of the position sensor 206 on the power end 102 of the pressure pump 100 to interpret the position signals received from the position sensor 206 (e.g., as a bolt pattern signal). In another example, the computing device 212 may use the position of the torque sensor 210 to determine which component of the power end 102 is opening abnormally.

In some aspects, the computing device 212 may generate graphical interfaces associated with the sensor data 222 or pump data 224, and information generated by the processor 214 therefrom, to be displayed via a display unit 218. The display unit 218 may be coupled to the processor 214 and may include any CRT, LCD, OLED, or other device for displaying interfaces generated by the processor 214. In some aspects, the computing device 212 may also generate an alert or other communication of the performance of the pressure pump 100 based on determinations by the computing device 212 in addition to, or instead of, the graphical interfaces. For example, the display unit 218 may include audio components to emit an audible signal when an abnormal condition is present in the pressure pump 100.

In some aspects the pressure pump 100 may also be fluidly coupled to (e.g., in fluid communication with) a wellbore 226. For example, the pressure pump 100 may be used in hydraulic fracturing to inject fluid into the wellbore 226. Subsequent to the fluid passing through the chambers 106 of the pressure pump 100, the fluid may be injected into the wellbore 226 at a high pressure to break apart or otherwise fracture rocks and other formations in the wellbore 226 to release hydrocarbons. The monitoring system 204 may monitor the pressure pump 100 to determine when to halt the fracturing process for maintenancing the pressure pump 100. Although hydraulic fracturing is described here, the pressure pump 100 may be used for any process or environment requiring a positive displacement pressure pump.

Figure 3:
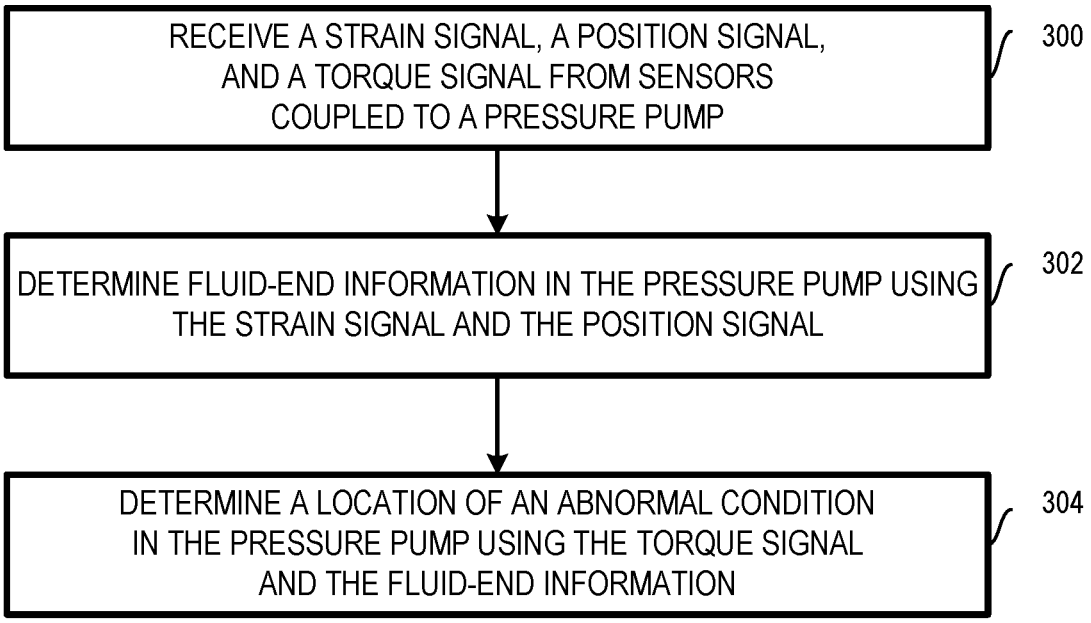
FIG. 3 is a flow chart of an example of a process for monitoring a condition of a power end of a pressure pump according to one aspect of the present disclosure.

FIG. 3 is a flow chart of an example of a process for monitoring a condition of a pressure pump according to one aspect of the present disclosure. The process is described with respect to the components described in FIG. 2, although other implementations are possible without departing from the scope of the present disclosure.

In block 300, a strain signal, position signal, and a torque signal are received from the strain gauge 208, the position sensor 206, and the torque sensor 210, respectively. In some aspects, the signals may be received by the computing device 212 from the stain gauge 208, the position sensor 206, and the torque sensor 210 positioned on the pressure pump 100. For example, the strain gauge 208 may be positioned on the fluid end 104 of the pressure pump 100 and correspond to strain in the chamber 106. In some aspects, a strain gauge 208 may be positioned on each chamber 106 of the pressure pump 100 to generate signals corresponding to the strain in each chamber 106, respectively. The position sensor 206 may be positioned on the power end 102 of the pressure pump. The position signals generated by the position sensor 206 may correspond to the position of a rotating component of a rotating assembly that is mechanically coupled to the plunger 114. For example, the position sensor 206 may be positioned on a crankcase of the crankshaft 108 to generate signals corresponding to the position, or rotation, of the crankshaft 108. The torque sensor 210 may be positioned on either the power end 102 or the fluid end 104 of the pressure pump 100 to measure the torque of a component of the pressure pump 100. The torque signal may correspond to the measured torque of a component on which the torque sensor 210 is positioned or to which the torque sensor 210 is proximate. In some aspects, the torque sensor may be positioned at the input of the power end 102 to measure the torque across the power source 200 or transmission 202.

In block 302, information corresponding to the fluid end 104 of the pressure pump 100 is determined using a strain signal and a position signal generated by the strain gauge 208 and the position sensor 206, respectively. In some aspects, the fluid-end information may correspond to information associated with the components of the pressure pump 100 positioned in the fluid end 104. In additional and alternative aspects, the fluid-end information may correspond to information associated with the fluid within the fluid end 104, such as properties of the fluid or the flow rate of fluid through fluid end 104.

Figure 4:
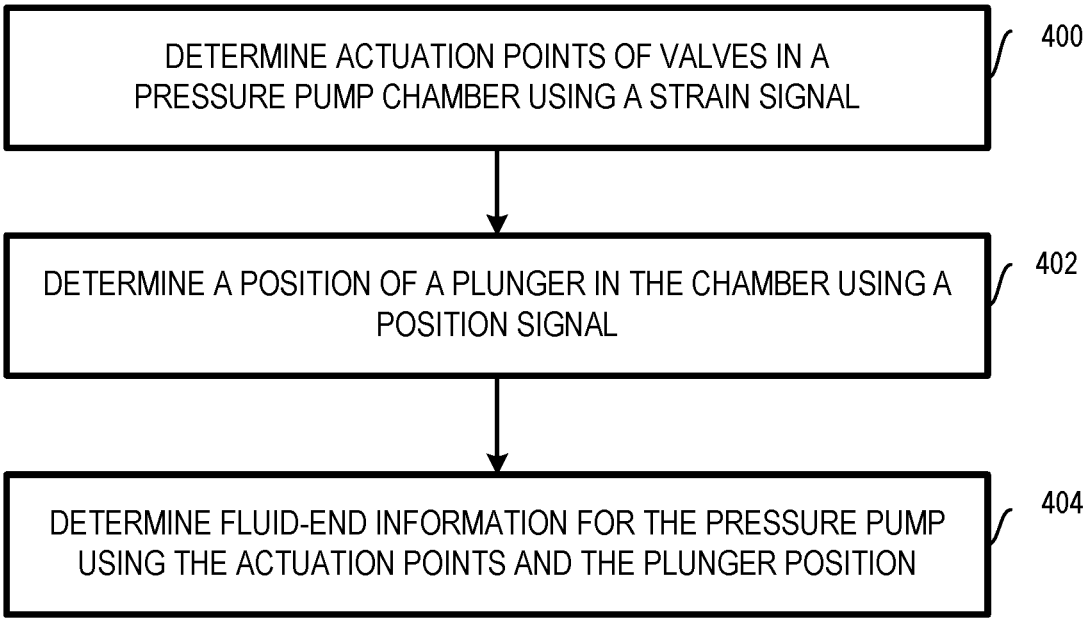
FIG. 4 is a flow chart of an example of a process for determining information corresponding to a fluid end of a pressure pump according to one aspect of the present disclosure.

FIG. 4 is a flow chart of an example of a process for determining fluid-end information according to one aspect of the present disclosure. The process is described with respect to the components described in FIG. 2, unless otherwise indicated, although other implementations are possible without departing from the scope of the present disclosure.

Figure 5:
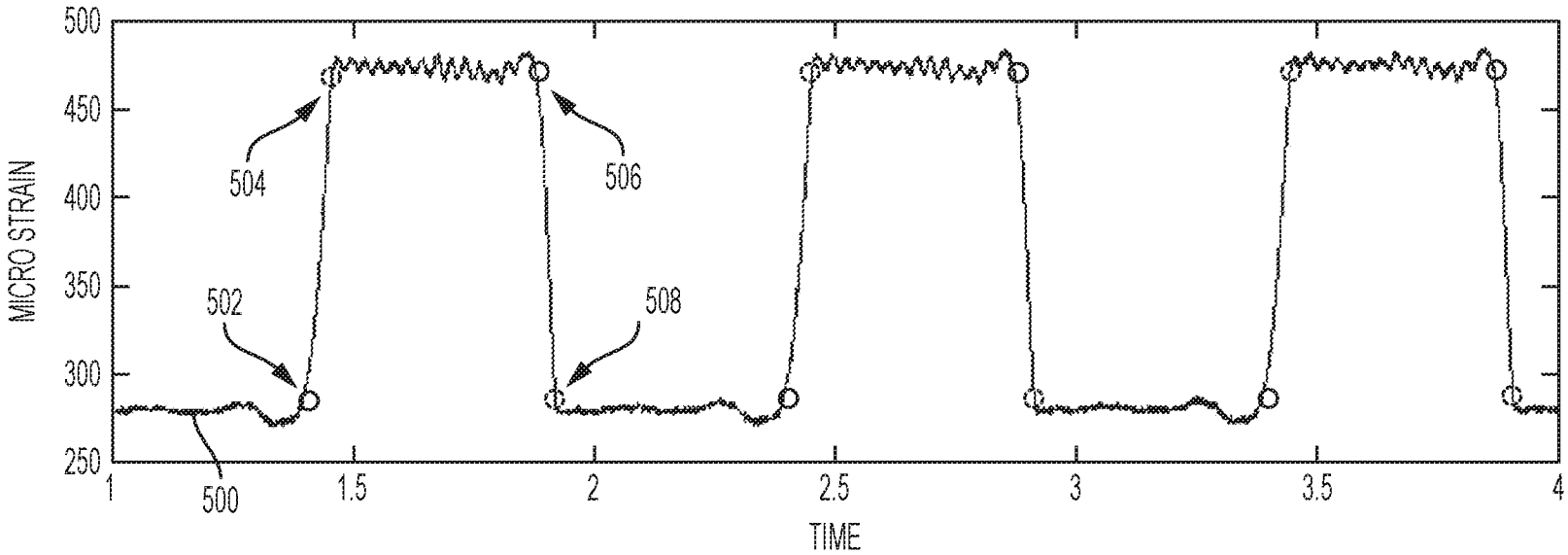
FIG. 5 is a signal graph depicting an example of a signal generated by a strain gauge of the monitoring system of FIG. 2 according to one aspect of the present disclosure.

In block 400, actuation points of the valves 116, 118 of the chamber 106 are determined using the strain signal generated by the strain gauge 208. FIG. 5 shows an example of a strain signal 500 that may be generated by the strain gauge 208. In some aspects, the computing device 212 may determine actuation points 502, 504, 506, 508 of the suction valve 116 and the discharge valve 118 for the chamber 106 based on the strain signal 500. The actuation points 502, 504, 506, 508 represent the point in time where the suction valve 116 and the discharge valve 118 open and close. For example, the computing device 212 may execute instructions 220 including signal-processing processes for determine the actuation points 502, 504, 506, 508. For example, the computing device 212 may execute instruction 220 to determine the actuation points 502, 504, 506, 508 by determining discontinuities in the strain signal 500. In some aspects, the stress in the chamber 106 may change during the operation of the suction valve 116 and the discharge valve 118 to cause the discontinuities in the strain signal 500 during actuation of the valves 116, 118. The computing device 212 may identify these discontinuities as the opening and closing of the valves 116, 118.

In one example, the strain in the chamber 106 may be isolated to the fluid in the chamber 106 when the suction valve 116 is closed. The isolation of the strain may cause the strain in the chamber 106 to load up until the discharge valve 118 is opened. When the discharge valve 118 is opened, the strain may level until the discharge valve 118 is closed, at which point the strain may unload until the suction valve 116 is reopened. The discontinuities may be present when the strain signal 500 shows a sudden increase or decrease in value corresponding to the actuation of the valves 116, 118. Actuation point 502 represents the suction valve 116 closing, actuation point 504 represents the discharge valve 118 opening, actuation point 506 represents the discharge valve 118 closing, and actuation point 508 represents the suction valve 116 opening to resume the cycle of fluid into and out of the chamber 106. The exact magnitudes of strain or pressure in the chamber 106 determined by the strain gauge 208 may not be required for determining the actuation points 502, 504, 506, 508. The computing device 212 may determine the actuation points 502, 504, 506, 508 based on the strain signal 500 providing a characterization of the loading and unloading of the strain in the chamber 106.

Figure 6:
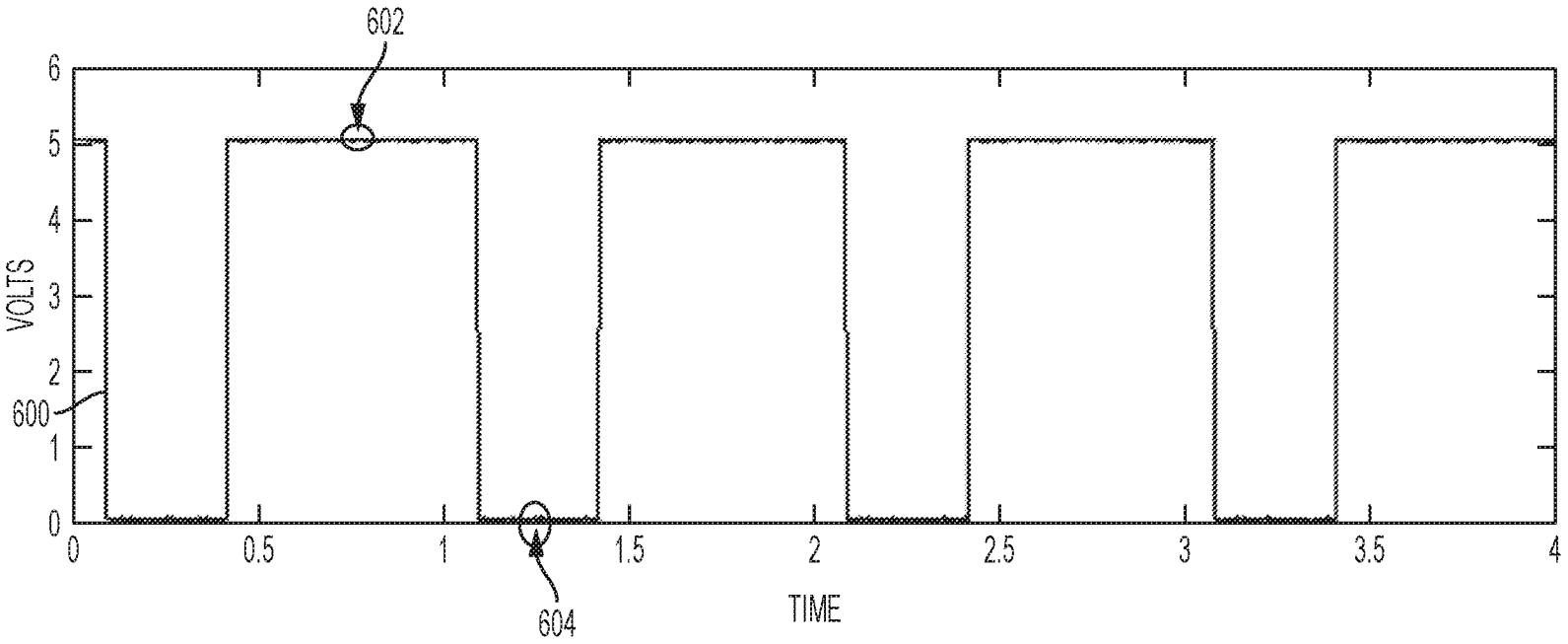
FIG. 6 is a signal graph depicting an example of a signal generated by a position sensor of the monitoring system of FIG. 2 according to one aspect of the present disclosure.
Figure 7:
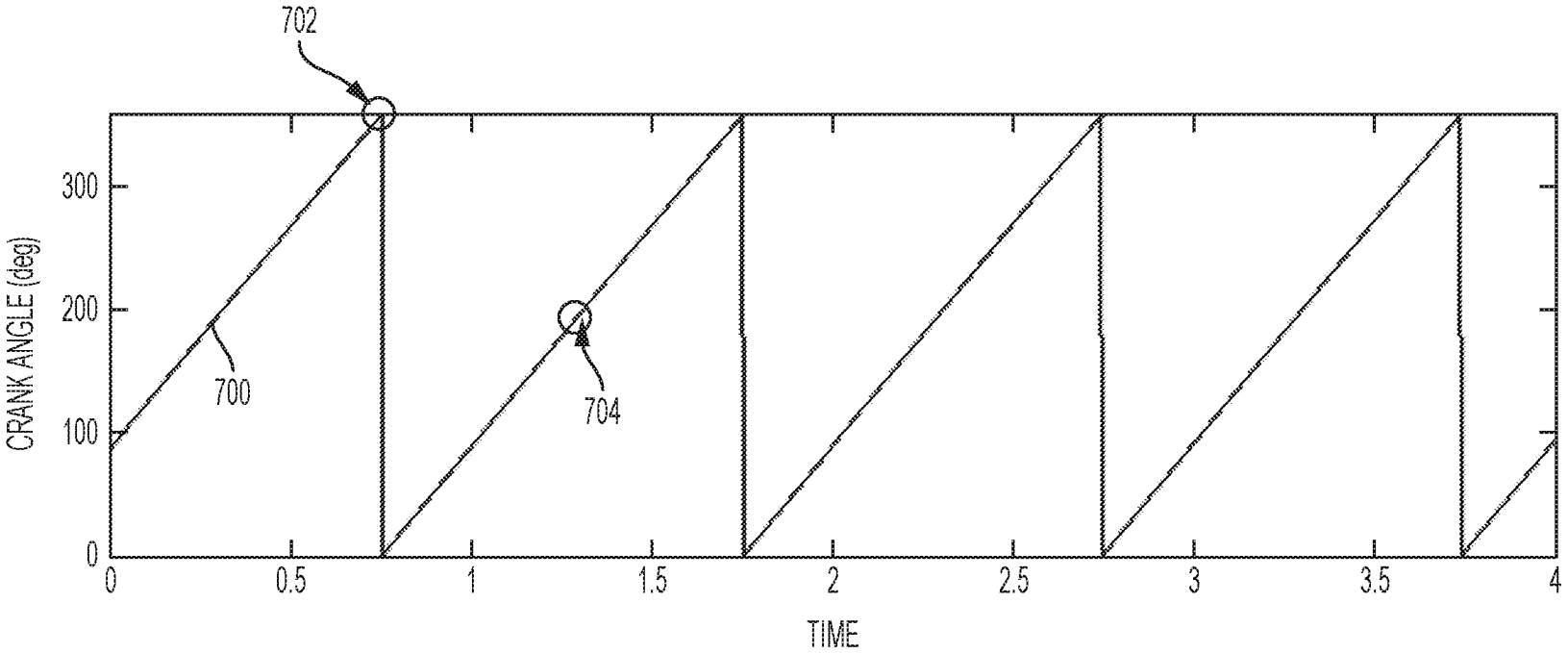
FIG. 7 is a signal graph depicting an example of another signal generated by a position sensor of the monitoring system of FIG. 2 according to one aspect of the present disclosure.

Returning to FIG. 4, in block 402, a position of the plunger 114 in the chamber 106 may be determined using the position signal generated by the position sensor 206. FIGS. 6 and 7 show examples of position signals 600, 700 that may be generated by the position sensor 206 during operation of the pressure pump 100. In some aspects, the position signals 600, 700 may represent the position of the crankshaft 108, which is mechanically coupled to the plunger 114 in each chamber 106.

FIG. 6 shows a position signal 600 displayed in volts over time (in seconds). The position signal 600 may be generated by the position sensor 206 coupled to the power end 102 of the pressure pump 100 and positioned in a path of the crosshead 112. The position signal 600 may represent the position of the crankshaft 108 over the indicated time as the crankshaft 108 operates to cause the plunger 114 to move within the chamber 106. The mechanical coupling of the plunger 114 to the crankshaft 108 may allow the computing device 212 to determine a position of the plunger 114 relative to the position of the crankshaft 108 based on the position signal 600. In some aspects, the computing device 212 may determine plunger position reference points 602, 604 based on the position signal 600 generated by the position sensor 206. For example, the processor 214 may determine dead center positions of the plunger 114 based on the position signal 600. The dead center positions may include the position of the plunger 114 in which it is farthest from the crankshaft 108, known as the top dead center. The dead center positions may also include the position of the plunger 114 in which it is nearest to the crankshaft 108, known as the bottom dead center. The distance between the top dead center and the bottom dead center may represent the length of a full stroke of the plunger 114 operating in the chamber 106.

In FIG. 6, the top dead center is represented by reference point 602 and the bottom dead center is represented by reference point 604. In some aspects, the processor 214 may determine the reference points 602, 604 by correlating the position signal 600 with a known ratio or other expression or relationship value representing the relationship between the movement of the crankshaft 108 and the movement of the plunger 114 (e.g., the mechanical correlations of the crankshaft 108 to the plunger 114 based on the mechanical coupling of the crankshaft 108 to the plunger 114 in the pressure pump 100). The computing device 212 may determine the top dead center and bottom dead center based on the position signal 600 or may determine other plunger-position reference points to determine the position of the plunger over a full stroke of the plunger 114, or a pump cycle of the pressure pump 100.

FIG. 7 shows a position signal 700 displayed in degrees over time (in seconds). The degree value may represent the rotational angle of the crankshaft 108 during operation of the crankshaft 108 or pressure pump 100. In some aspects, the position signal 700 may be generated by the position sensor 206 located directly on the power end 102 (e.g., positioned directly on the crankshaft 108 or a crankcase of the crankshaft 108). The position sensor 206 may generate the position signal 700 based on the bolt pattern of the crankshaft 108 as the position sensor 206 rotates in response to the rotation of the crankshaft 108 during operation. Similar to the position signal 600 shown in FIG. 6, the computing device 212 may determine plunger-position reference points 702, 704 based on the position signal 700. The reference points 702, 704 in FIG. 7 represent the top dead center and bottom dead center of the plunger 114 for the chamber 106 during operation of the pressure pump 100.

Figure 8:
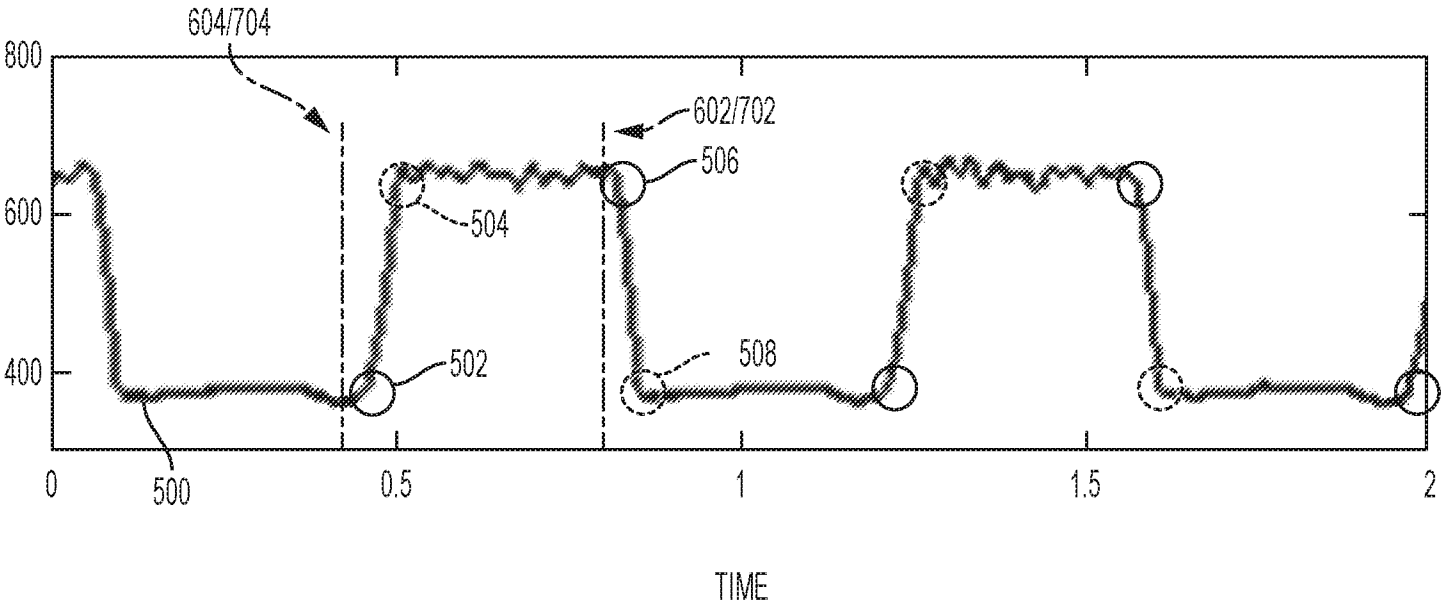
FIG. 8 is a signal graph depicting actuation of a suction valve and a discharge valve relative to the strain signal of FIG. 4 and a plunger position according to one aspect of the present disclosure.

In some aspects, the actuation points 502, 504, 506, 508 may be cross-referenced with the position signals 600, 700 to determine the position and movement of the plunger 114 in reference to the actuation of the suction valve 116 and the discharge valve 118. The cross-referenced actuation points 502, 504, 506, 508 and position signals 600, 700 may show an actual position of the plunger 114 at the time when each of the valves 116, 118 actuate. FIG. 8 shows the strain signal 500 of FIG. 5 with the actuation points 502, 504, 506, 508 of the valves 116, 118 shown relative to the position of the plunger 114. The actuation points 502, 504 are shown relative to the plunger 114 positioned at the bottom dead center (represented by reference points 604, 704) for closure of the suction valve 116 and opening of the discharge valve 118. The actuation points 506, 508 are shown relative to the plunger 114 positioned at top dead center (represented by reference points 602, 702) for opening of the suction valve 116 and closing of the discharge valve 118.

Returning to FIG. 4, in block 404, information corresponding to the fluid end 104 of the pressure pump 100 may be determined using the actuation points 502, 504, 506, 508 of FIG. 5 and the plunger position represented by the reference points 602, 604, 702, 704 of FIGS. 6 and 7. Non-limited examples of information corresponding to the fluid end 104 that may be determined using the actuation points 502, 504, 506, 508 and the plunger position include a bulk modulus of the fluid of the pressure pump 100 in the fluid end 104, and a flow rate of the fluid, leaks in or damage to the valves 116, 118 or the chamber 106, and potential cavitation in the chambers 106.

The bulk modulus of the fluid system may include the resistance of the fluid in the pressure pump to uniform compression. The reciprocal of the bulk modulus may provide the fluid's compressibility, which is the measure of the relative volume change of the fluid in response to a change in pressure. In some aspects, the instructions 220 stored in the memory 216 may include the following relationship for determining bulk modulus:

$$\beta_e = -\Delta P \frac{V_o}{\Delta V}$$

where $\beta_e$ is the effective bulk modulus of the fluid in the pressure pump 100 in psi, $\Delta P$ is the change in pressure in psi, $V_o$ is an initial volume of fluid, and $\Delta V$ is a change in the volume of fluid. The units of measurement for volume may not be significant to the relationship between the measurements as long as units associated with input values are consistent. The instructions 220 may also include the following relationship for determining effective bulk modulus, representing the bulk modulus of each of the components of the pressure pump 100 associated with the chamber 106:

$$\frac{1}{\beta_e} = \frac{1}{\beta_1} + \frac{1}{\beta_2} + \frac{1}{\beta_3} \cdots$$

where $\beta_e$ is the effective bulk modulus in psi and the other terms ($\beta_1$, $\beta_2$, $\beta_3$, etc.) represent the additional components that affect the effective bulk modulus. The bulk modulus of the fluid system may be determined using the effective bulk modulus. For example, the instructions 220 may also include the following relationship for determining the bulk modulus of the fluid system components:

$$\frac{1}{\beta_{fluid}} = \frac{1}{\beta_e} - \frac{1}{\beta_{mechanical}}$$

where $\beta_{fluid}$ is the bulk modulus of the fluid system in psi, $\beta_e$ is the effective bulk modulus in psi, and $\beta_{mechanical}$ is the bulk modulus of the additional, non-fluid components associated with the chamber 106.

In some aspects, the processor 214 may execute the instructions to determine the bulk modulus of the fluid during a time where a portion of the fluid in the pressure pump 100 is isolated in the chamber 106 (e.g., when both the suction valve 116 and the discharge valve 118 are in a closed position). In one example, the actuation points 502, 504, 506, 508 determined from the strain signal 500 may indicate that fluid is isolated in the chamber from the actuation point 502 representing the closing of the suction valve 116 until the actuation point 504 representing the opening of the discharge valve 118). The processor 214 may determine a change in internal pressure in the chamber during the time the fluid is isolated in the chamber by correlating the strain in the chamber 106 with a known internal pressure stored in the pump data 224. In some aspects, the known internal pressure may be previously determined based on engineering estimations, testing, experimentation, or calculations. The processor 214 may determine the initial volume of fluid in the chamber at the actuation point 502 and the change in the volume of fluid in the chamber during the time that the fluid is isolated in the chamber using the position of the plunger 114. For example, the processor 214 may correlate movement of the plunger 114 with the amount of time between the actuation points 502, 504 to identify the volume of fluid displaced by the plunger 114 in the chamber 106 during that time, as described with respect to FIG. 8. The volume of the displaced fluid may correspond to a change in volume of the fluid for purposes of determining the effective bulk modulus of the fluid in the pressure pump 100. The processor 214 may execute the instructions 220 to determine the effective bulk modulus using the change in pressure, the initial volume of fluid in the chamber 106 at the actuation point 502, and the change in the fluid volume in the chamber 106 between the actuation points 502, 504 to determine the effective bulk modulus as inputs. The processor 214 may determine the bulk modulus of the fluid system by removing the known bulk modulus of mechanical, non-fluid components of the pressure pump 100 from the effective bulk modulus.

The flow rate of the fluid through the pressure pump 100 may correspond to the volume of fluid entering the chamber 106 or the volume of fluid being discharged from the chamber 106 during pumping operations of the pressure pump 100. In some aspects, the flow rate may be determined by the processor 214 using the actuation points 502, 504, 506, 508 of FIG. 5 and the position of the plunger extrapolated from the position of the crankshaft 108 represented by the position signals 600, 700 of FIGS. 6 and 7. For example, the processor 214 may determine the amount of time between the actuation points representing the opening and closing of one of the suction valve 116 or the discharge valve 118 (e.g., actuation points 504, 506 representing the opening time and the closing time of the discharge valve 118, respectively). This time may represent the amount of time that the suction valve 116 or the discharge valve 118 is in an open position to allow fluid to enter or exit the chamber, respectively. The processor 214 may correlate the movement of the plunger 114 and the period when the valve 116, 118 is in the open position. The stroke of the plunger 114 may correspond to the volume of fluid entering the chamber from the inlet manifold 120 or the volume of fluid discharged from the chamber 106 into the discharge manifold. The rate of fluid flowing into the chamber 106 or into the discharge manifold 122 from the chamber may correspond to the flow rate of fluid through the pressure pump.

The condition of the chamber 106 (e.g., the presence of potential leaks or cavitation) may be determined using the correlation of the actuation points 502, 504, 506, 508 of the valves 116, 118 and the position of the plunger 114 as described in FIG. 8. For example, the time distance between the actuation points 502, 504, 506, 508 and the plunger-position reference points 602, 604, 702, 704 may represent delays in the actuation of the valves 116, 118. In some aspects, the time between the closing of the suction valve 116 (represented by the actuation point 502) or the opening of the discharge valve 118 (represented by the actuation point 504) and the bottom dead center of the plunger 114 (represented by reference points 604, 704) may represent a delay in the closing of the suction valve 116 or the opening of the discharge valve 118, respectively. Similarly, the time between the closing of the discharge valve 118 (represented by actuation point 506) or the opening of the suction valve 116 (represented by actuation point 508) and the top dead center of the plunger 114 (represented by reference points 602, 604) may represent a delay in the closing of the discharge valve 118 or the opening of the suction valve 116, respectively. The valve-actuation delays corresponding to the suction valve 116 and the discharge valve 118 may be compared to expected delays to determine whether a potential leak or potential cavitation may be present. In some aspects, the expected delays may be stored as pump data 224 in the memory 216. In additional and alternative aspects, the processor 214 may determine the expected delays by comparing the actuation delays of the valves 116, 118 to valves of a similar type (e.g., other suction valves or other discharge valves) performing the same operation (e.g., opening or closing) in other chambers 106 in the pressure pump 100 or in chambers of similarly operating pressure pumps in the wellbore environment. In further aspects, the expected values may be determined from fluid properties, such as the bulk modulus of the fluid, and calculations of the expected values for fluid in a similarly operating pressure pump having the same fluid properties.

Returning to FIG. 3, in block 304, a location of an abnormal condition in the pressure pump 100 may be determined using the torque signal received in block 300 and the fluid-end information determined in block 302. In some aspects, an abnormal condition may correspond to damage to a component of the pressure pump 100. In additional and alternative aspects, the abnormal condition may correspond to an unexpected operation by the component.

Figure 9:
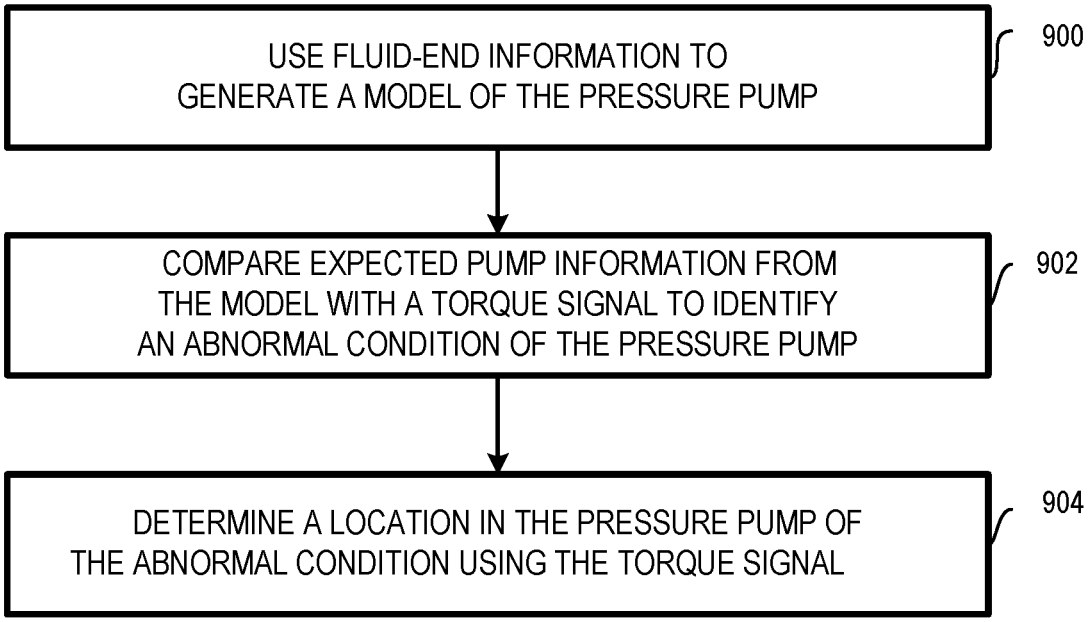
FIG. 9 is a flow chart of an example of a process for identifying a location of an issue in the pressure pump according to one aspect of the present disclosure.

FIG. 9 is a flowchart of a process for determining a location of an abnormal condition in the pressure pump using a torque signal generated by the torque sensor 210. The process is described with respect to FIG. 2, although other implementations are possible without departing from the scope of the present disclosure.

In block 900, the fluid-end information determined in block 404 of FIG. 4 is used to generate a model of the pressure pump 100. In some aspects, the model of the pressure pump 100 may correspond to a computer-generated simulation of the pressure pump 100 operating under similar conditions as the pressure pump 100. For example, the fluid properties (e.g., bulk modulus) of the fluid in the pressure pump 100 may be used in the model to cause the simulation of the pressure pump 100 to be operable to pump fluid having the same or similar properties. The flow rate of the fluid may be used in the model to cause the simulation to be operable to pump fluid through the simulated pressure pump at the same flow rate as the fluid pumped through the pressure pump. The behavior of the valves (e.g., the actuation points 502, 504, 506, 508 and the actuation delays) and the movement of the plunger 114 may be used to cause the valves and plunger in the simulated pump to operate similar or identical to the pressure pump 100.

Figure 10:
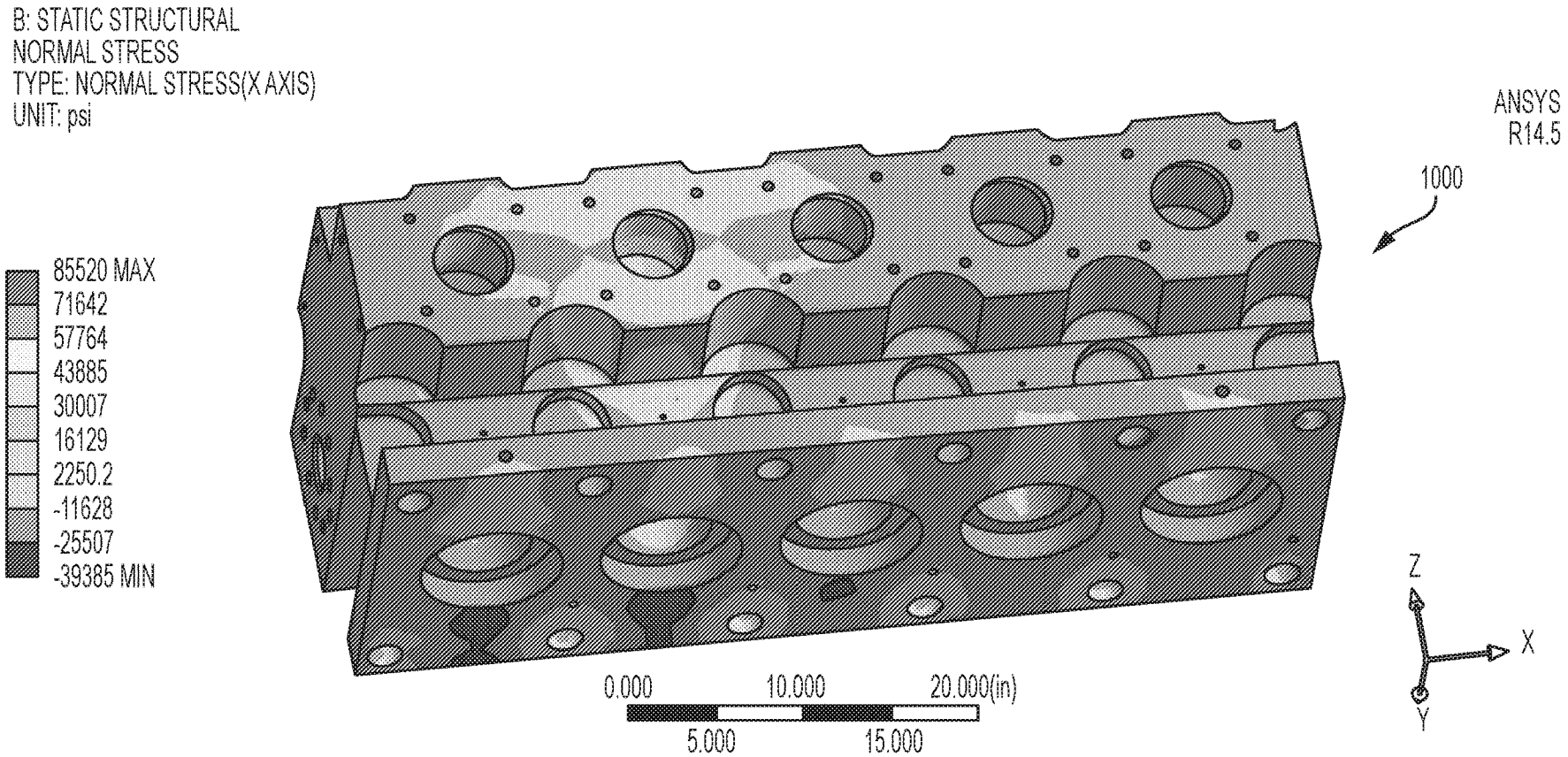
FIG. 10 is an example of a finite element model used to determine expected conditions of the pressure pump according to one aspect of the present disclosure.

The model may be generated using known simulation methods based on engineering estimations, finite element analysis, or by some other analysis. For example, finite element analysis may be performed to predict how the pressure pump 100 may respond or react to real-world forces. FIG. 10 shows an example of a finite element model 1000 that may represent the pressure pump 100. In some aspects, an operator may input or store pump properties corresponding to the fluid-end information as pump data 224 in the memory 216 of the computing device 212. The computing device 212 may perform finite element analysis to generate the finite element model 1000 representing the pressure pump 100 based on the inputted pump data 224 and corresponding to the determined properties of the fluid end 104 of the pressure pump 100. The operation of the simulated pressure pump in the finite element model 1000 may be used to generate information corresponding to the expected operation and expected properties of the pressure pump 100.

Returning to FIG. 9, in block 902, the expected information generated from the model 1000 may be compared to the torque signal received in block 300 of FIG. 3 to identify an abnormal condition of the pressure pump 100. In some aspects, the expected information may include a simulated torque signal corresponding to the torque of the components of the simulated pressure pump in the model 1000. The abnormal condition of the pressure pump may correspond to an instance where the torque signal generated by the torque sensor 210 is substantially different from the torque signal generated for the simulated pressure pump 100 of the model for the same component of set of the components. In some aspects, the difference may be substantial where the discrepancies between the actual torque signal and the simulated torque signal are outside a predetermined threshold (e.g., 5%). In some aspects, an abnormal condition may correspond to a problem in the pressure pump. Non-limiting examples of problems that may be determined using the torque signal according to aspects of the present disclosure include: loss of lubrication to a crosshead 112, dragging of the crosshead 112 or the crankshaft 108, malfunctioning of the transmission 202 (e.g., a gear slip during lockup, a defective speed reducer, etc.), or malfunctioning of the valves 116, 118).

In block 904, the location of the abnormal condition indicated by the discrepancies between the actual torque signal and the simulated torque signal may be determined. In some aspects, the location may be determined based on the component having the torque corresponding to the actual torque signal. For example, the torque signal may correspond to the torque of the crankshaft 108. The location of the abnormal condition may indicate that a problem exists with the crankshaft 108 during operation of the pressure pump 100. In some aspects, the location of the abnormal condition in the pressure pump 100 may correspond to the location of the torque sensor 210 on the pressure pump 100.

In some aspects, the torque signal may be used in combination with other information, such as the fluid-end information to determine the location of the abnormal condition. For example, the torque sensor 210 may be positioned at the input of the power end 102 and generate signals corresponding to the torque of the power source 200 operating the crankshaft 108. The torque signal may indicate an abnormal condition based on erratic behavior of the power source 200 (e.g., fluctuations in rotations per minute). The fluid-end information or other information generated by the model 1000 or other sensors (e.g., an additional torque sensor) in the pressure pump 100 may be used to identify the cause of the erratic behavior of the power source 200 in the power end 102 or the fluid end 104 of the pressure pump.

The foregoing description of the examples, including illustrated examples, has been presented only for the purpose of illustration and description and is not intended to be exhaustive or to limit the subject matter to the precise forms disclosed. Numerous modifications, combinations, adaptations, uses, and installations thereof can be apparent to those skilled in the art without departing from the scope of this disclosure. The illustrative examples described above are given to introduce the reader to the general subject matter discussed here and are not intended to limit the scope of the disclosed concepts.

What is claimed is:

1. A monitoring system for a wellbore pressure pump, comprising:

a strain gauge positionable on a pressure pump to generate a strain signal representing strain in a chamber of the pressure pump;

a position sensor positionable on the pressure pump to generate a position signal representing the position of a rotating member of the pressure pump;

a torque sensor positionable on or proximate to the pressure pump to generate a torque signal representing torque of a component of the pressure pump, the torque signal being usable with the strain signal and the position signal to determine a condition in the pressure pump; and a computing device communicatively coupled to the strain gauge, the position sensor, and the torque sensor, the computing device including a processing device and a memory device storing instructions that are executable by the processing device to cause the processing device to:

determine expected pump information based on the strain signal and the position signal;

determine the condition in the wellbore pressure pump by comparing the expected pump information to the torque signal to identify the condition; and determine a location of the condition using the torque signal.

2. The monitoring system of claim 1, wherein the instructions are executable by the processing device to cause the processing device to:

determine actuation points for one or more valves of the chamber using the strain signal;

determine a movement of a displacement member for the chamber by correlating the position of the rotating member with an expression representing a mechanical correlation of the displacement member to the rotating member; and determine information corresponding to a fluid end of the pressure pump by correlating the actuation points with the movement of the displacement member.

3. The monitoring system of claim 2, wherein the expected pump information includes an expected torque value, and wherein the instructions are executable by the processing device to cause the processing device to determine the condition in the pressure pump by comparing the torque signal to the expected torque value based on the information corresponding to the fluid end, wherein the information is associated with fluid or fluid-end components located in the fluid end of the pressure pump.

4. The monitoring system of claim 3, wherein the instructions are executable by the processing device to cause the processing device to:

generate a model simulating an operation of the pressure pump using at least the information corresponding to the fluid end of the pressure pump; and determine the expected torque value based on a simulated operation of the pressure pump of the model.

5. The monitoring system of claim 2, wherein the information corresponding to the fluid end of the pressure pump includes at least a bulk modulus of fluid in the fluid end and a flow rate of fluid through the pressure pump.

6. The monitoring system of claim 2, wherein the information corresponding to the fluid end of the pressure pump includes actuation delays corresponding to cavitation in the chamber or a leak in a valve of the one or more valves, wherein the actuation delays correspond to a delay in an opening or a closing of the valve.

7. The monitoring system of claim 1, wherein the torque sensor is positionable on a power end of the pressure pump, wherein the component having the torque represented by the torque signal is located in the power end or across a power source for the pressure pump, and wherein the condition corresponds to a malfunction of the component.

8. The monitoring system of claim 1, wherein the torque sensor is integrated into a transmission of the pressure pump that is positioned at an input to a power end of the pressure pump.

9. A pumping system for a wellbore environment, comprising:

a pressure pump comprising:

a chamber having a valve actuatable to open and close at actuation points that are detectable by a strain gauge; and a rotating member operable to cause a displacement member to displace fluid in the chamber based on a position of the rotating member that is detectable by a position sensor; and a computing device communicatively couplable to the pressure pump and comprising a processing device and a memory device storing instructions that are executable by the processing device to:

determine a condition of the pressure pump by comparing a torque signal representing a torque measurement of a component in the pressure pump to an expected torque value that is determined from a strain signal generated by the strain gauge and a position measurement generated by the position sensor; and determine a location of the condition using the torque signal.

10. The pumping system of claim 9, wherein the computing device is communicatively couplable to the pressure pump to receive, from a torque sensor, the torque signal representing the torque measurement of the component, and wherein the memory device further includes instructions that are executable by the processing device to cause the processing device to:

determine actuation points for the valve of the chamber using the strain signal;

determine a movement of the displacement member for the chamber by correlating the position of the rotating member with an expression representing a mechanical correlation of the displacement member to the rotating member; and determine information corresponding to a fluid end of the pressure pump by correlating the actuation points with the movement of the displacement member.

11. The pumping system of claim 10, wherein the instructions are executable by the processing device to cause the processing device to determine the expected torque value based on the information corresponding to the fluid end.

12. The pumping system of claim 11, wherein the instructions are executable by the processing device to cause the processing device to:

generate a model simulating an operation of the pressure pump using at least the information corresponding to the fluid end; and determine the expected torque value based on a simulated operation of the pressure pump of the model.

13. The pumping system of claim 9, wherein the strain gauge is positioned on a fluid end of the pressure pump to generate the strain signal representing strain in the chamber, wherein one or more discontinuities in the strain signal correspond to actuation points of a valve.

14. The pumping system of claim 9, further including a transmission positionable at an input to a power end of the pressure pump, the transmission including a torque sensor integrated into the transmission to generate the torque signal representing the torque measurement of the component.

15. A method, comprising:

receiving, from a position sensor, a position signal representing a position of a rotating member of a wellbore pressure pump;

receiving, from a strain gauge, a strain signal representing strain in a chamber of the wellbore pressure pump;

receiving, from a torque sensor, a torque signal representing a torque measurement of a component of the wellbore pressure pump;

determining, by a processing device, fluid-end information corresponding to a fluid end of the wellbore pressure pump using the position signal and the strain signal;

determining, by the processing device, a condition in the wellbore pressure pump by comparing the torque signal to expected pump information based on the fluid-end information; and determining a location of the condition using the torque signal.

16. The method of claim 15, wherein determining the fluid-end information includes:

determining actuation points for a valve of the chamber using the strain signal;

determining a movement of a displacement member for the chamber by correlating the position of the rotating member with an expression representing a mechanical correlation of the displacement member to the rotating member; and correlating the actuation points with the movement of the displacement member.

17. The method of claim 15, wherein the fluid-end information includes fluid information corresponding to fluid in the fluid end of the wellbore pressure pump and component information corresponding to fluid-end components located in the fluid end of the wellbore pressure pump, wherein the fluid information includes at least one of a bulk modulus of the fluid or a flow rate of the fluid, and wherein the component information includes actuation delays corresponding to at least one of cavitation in the chamber or a leak in a valve of the chamber.

18. The method of claim 15, wherein determining the condition in the wellbore pressure pump further comprises:

generating a model of the wellbore pressure pump using the fluid-end information, the model including a simulation of pumping operations of the wellbore pressure pump based an input of the fluid-end information; and deriving the expected pump information from the model.

19. The method of claim 18, wherein the expected pump information includes an expected torque value based on the simulation of the pumping operations of the wellbore pressure pump, and wherein comparing the expected pump information with the torque signal includes identifying discrepancies between the torque signal and the expected torque value.

20. The method of claim 19, wherein determining the location of the condition includes identifying a position of the component associated with the torque measurement.

* * * * *